US005782702A

United States Patent [19]

Yamagishi et al.

[11] Patent Number: 5,782,702

[45] Date of Patent: Jul. 21, 1998

[54] PRACTICE GOLF BALL

[75] Inventors: Hisashi Yamagishi; Jun Shindo; Hiroto Sasaki, all of Chichibu, Japan

[73] Assignee: Bridgestone Sports Co., Ltd., Tokyo, Japan

[21] Appl. No.: 841,669

[22] Filed: Apr. 30, 1997

[30] Foreign Application Priority Data

May 1, 1996 [JP] Japan ..... 8-134249

[51] Int. Cl.[6] ..... A63B 37/14; A63B 69/36

[52] U.S. Cl. ..... 473/280; 473/377; 473/384; 273/DIG. 20

[58] Field of Search ..... 473/377, 383, 473/384, 280, 351; 273/DIG. 20

[56] References Cited

U.S. PATENT DOCUMENTS 5,601,503 2/1997 Yamagishi et al. ..... 473/384

*Primary Examiner*—George J. Marlo

*Attorney, Agent, or Firm*—Sughrue, Mion, Zinn, Macpeak & Seas, PLLC

[57] ABSTRACT

A practice golf ball having a multiplicity of dimples formed in its surface has a weight of 46.5–49.0 grams and undergoes a distortion of 2.5–4.0 mm under a constant load of 100 kg. A percent dimple volume Vr is in the range of $0.7\% \leqq Vr \leqq 1.1\%$ wherein the percent dimple volume Vr is the sum of the volumes of the entire dimples divided by the volume of a phantom sphere given on the assumption that the ball surface is free of dimples. The ball offers a good feel upon shots, follows a low trajectory without substantial shortage of a flight distance, and is thus suited for use in urban golf practice pits of limited space.

4 Claims, 3 Drawing Sheets

- BALL WEIGHT: 46.5-49.0 (g)
- DISTORTION UNDER 100kg LOAD: AT LEAST 2.5 (mm)

$0.7\% \leq Vr \leq 1.1\%$

WHEREIN Vr IS THE SUM OF THE VOLUME OF ENTIRE DIMPLES DIVIDED BY THE VOLUME OF A SPHERE GIVEN ON ASSUMPTION THAT BALL SURFACE HAS NO DIMPLES.

PRACTICE GOLF BALL

BACKGROUND OF THE INVENTION

1. Field of the Invention

This invention relates to a practice golf ball which will follow a low trajectory without detracting from flight performance and offers a good feel.

2. Prior Art

In Japanese cities, there are many urban golf practice pits which are constructed by surrounding a limited area with a net. Practice golf balls are used in the practice pits. If practice golf balls tend to follow a high trajectory, they will fly over the net and fall beyond the pit with the danger that they will damage something outside the pit. Practice golf balls which will follow a low trajectory so that the balls may not fly over the net are desired.

From this standpoint, JP-A 117969/1992 proposes a practice golf ball having a weight of 43 to 48 grams, a diameter of 1.65 to 1.71 inches, a dimple number of 300 to 550, and an overall dimple volume of 400 to 600 $mm^3$. This ball still follows a relatively high trajectory.

Although practice golf balls are used for practice, they are required not only to follow a low trajectory, but also to travel a satisfactory distance and present a good feel. Even the practice ball should give a pleasant feel on actual shots. Conventional practice golf balls have not fully taken such factors into account.

SUMMARY OF THE INVENTION

An object of the present invention is to provide a practice golf ball which will follow a low trajectory without detracting from flight performance and offers a good feel.

While competition golf balls must satisfy the standards in the Rules of Golf which prescribes a weight of not greater than 45.92 grams, practice golf balls need not necessarily satisfy the standards. Focusing on the ball weight, we first attempted to lower the trajectory of a golf ball in flight.

By increasing the weight of a golf ball to 46.5 to 49.0 grams beyond the limit of the Rules of Golf, we attempted to increase the gravity effect on the ball in flight to thereby prevent the ball from rising high, that is, to lower the trajectory. However, the gravity effect as such was insufficient to lower the trajectory and could reduce the flight distance. Through a further study, we attempted to adjust the aerodynamics of a golf ball by modifying dimples with respect to the overall volume of dimples to the ball volume. We have found that the trajectory can be lowered at a little sacrifice of flight distance when dimples are designed so as to meet a percent dimple volume Vr in the range of $0.7\% \leqq Vr \leqq 1.1\%$ wherein the percent dimple volume Vr is the sum of the volumes of the entire dimples (each being the volume of the dimple space below a circular plane circumscribed by the dimple edge) divided by the volume of a phantom sphere given on the assumption that the ball surface is free of dimples. Better results are obtained when the dimples satisfy $0.40 \leqq V_0 \leqq 0.65$ wherein $V_0$ is the volume of the dimple space below a circular plane circumscribed by the dimple edge, divided by the volume of a cylinder whose bottom is the circular plane and whose height is the maximum depth of the dimple from the bottom.

Simply when the ball weight is increased as mentioned above, the impact force the player receives upon shots becomes greater than balls of the normal weight, failing to reproduce the usual hitting feel. Then the feel or skill the player has gained from practice is not helpful for the player to play on the course. When the ball is formed to undergo a distortion of 2.5 to 4.0 mm under a load of 100 kg, the ball presents a good feel comparable to that of ordinary competition balls. The present invention is predicated on these findings.

According to the invention, there is provided a practice golf ball having a multiplicity of dimples formed in its surface. The ball has a weight of 46.5 to 49.0 grams and undergoes a distortion of 2.5 to 4.0 mm under a constant load of 100 kg. A percent dimple volume Vr is in the range of $0.7\% \leqq Vr \leqq 1.1\%$ wherein the percent dimple volume Vr is the sum of the volumes of the entire dimples (each being the volume of the dimple space below a circular plane circumscribed by the dimple edge) divided by the volume of a phantom sphere given on the assumption that the ball surface is free of dimples.

BRIEF DESCRIPTION OF THE DRAWINGS

These and further features of the present invention will be apparent with reference to the following description and drawings, wherein.

DETAILED DESCRIPTION OF THE INVENTION

Figure 1:
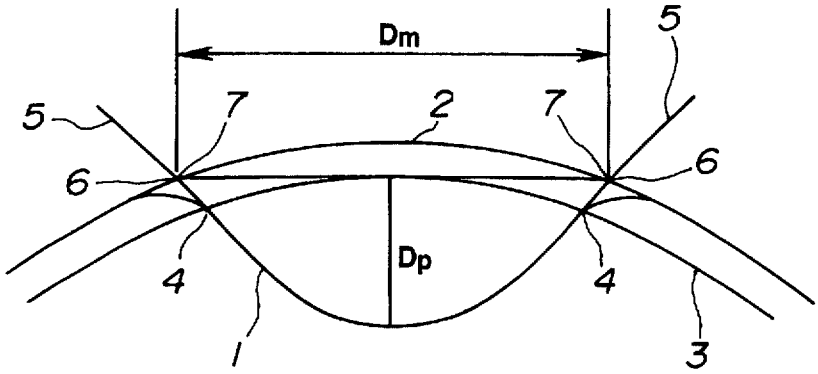
FIGS. 1, 2 and 3 are schematic cross-sectional views of a dimple in the ball surface illustrating how to calculate a factor $V_0$ of a dimple having a diameter Dm and a depth Dp.

The practice golf ball of the present invention may be either a one-piece golf ball or a two-piece golf ball having a solid core enclosed with a cover. According to the invention, the ball has a weight of 46.5 to 49.0 grams, especially 46.5 to 48.0 grams. With a weight of more than 49.0 grams, the flight distance is reduced due to a greater gravity effect and the hitting feel is exacerbated due to a greater impact force upon shots. A weight of less than 46.5 grams provides an insufficient gravity effect to lower the trajectory, allowing the ball to follow a high trajectory.

The diameter of the ball is not particularly limited and may be approximately equal to that of conventional practice golf balls, for example 42.3 to 43.0 mm, preferably 42.5 to 42.8 mm.

The ball undergoes a distortion of at least 2.5 mm, preferably at least 2.7 mm, more preferably at least 2.8 mm under a constant load of 100 kg. A ball with a distortion of less than 2.5 mm provides a greater impact force upon shots and hence, a less pleasant feel. The upper limit of distortion is 4.0 mm, preferably 3.8 mm. A ball with a distortion of more than 4.0 mm provides an inferior separation of the ball from a club upon shots and hence, a less pleasant feel.

The practice golf ball of the present invention has a multiplicity of dimples in its surface. A percent dimple volume Vr is defined as the sum of the volumes of the entire dimples (each being the volume of the dimple space below a circular plane circumscribed by the dimple edge) divided by the volume of a phantom sphere given on the assumption that the ball surface is free of dimples. Briefly stated, the percent dimple volume Vr is a proportion of the total volume of dimples to the volume of the ball. According to the invention, Vr is in the range of $0.7\% \leqq Vr \leqq 1.1\%$, preferably $0.8\% \leqq Vr \leqq 1.05\%$, more preferably $0.9\% \leqq Vr \leqq 1.0\%$. More preferably, the dimples should satisfy $0.40 \leqq V_0 \leqq 0.65$, especially $0.43 \leqq V_0 \leqq 0.60$ wherein $V_0$ is the volume of the dimple space below a circular plane circumscribed by the dimple edge, divided by the volume of a cylinder whose bottom is the circular plane and whose height is the maximum depth of the dimple from the bottom. By designing dimples so as to satisfy the values of Vr and $V_0$ in the above-defined ranges, the dimples become effective for reducing a coefficient of drag and increasing a coefficient of lift, thereby increasing a flight distance. With $V_0>0.65$, the ball would loft sharply and stall, traveling a short distance. With $V_0<0.40$, the trajectory would become rather declining. Vr<0.7% would allow the ball to receive more spin and Vr>1.1% would decline the effect of dimples decreasing a coefficient of drag, both resulting in a short flight distance.

Figure 2:
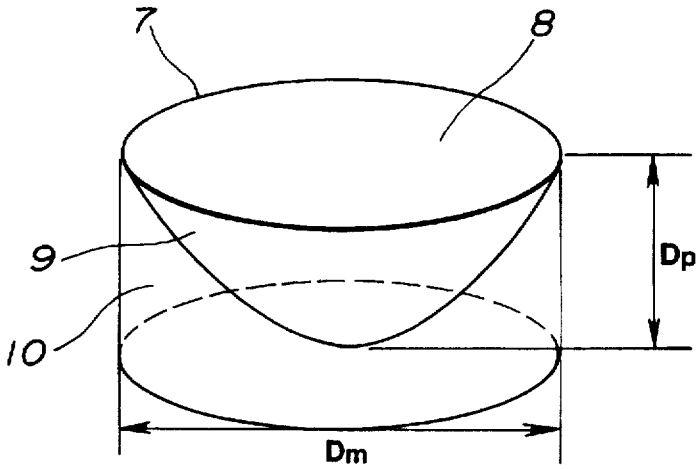
Figure 3:
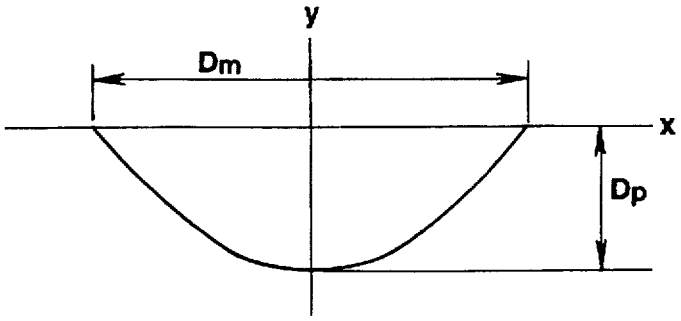
Figure 4:
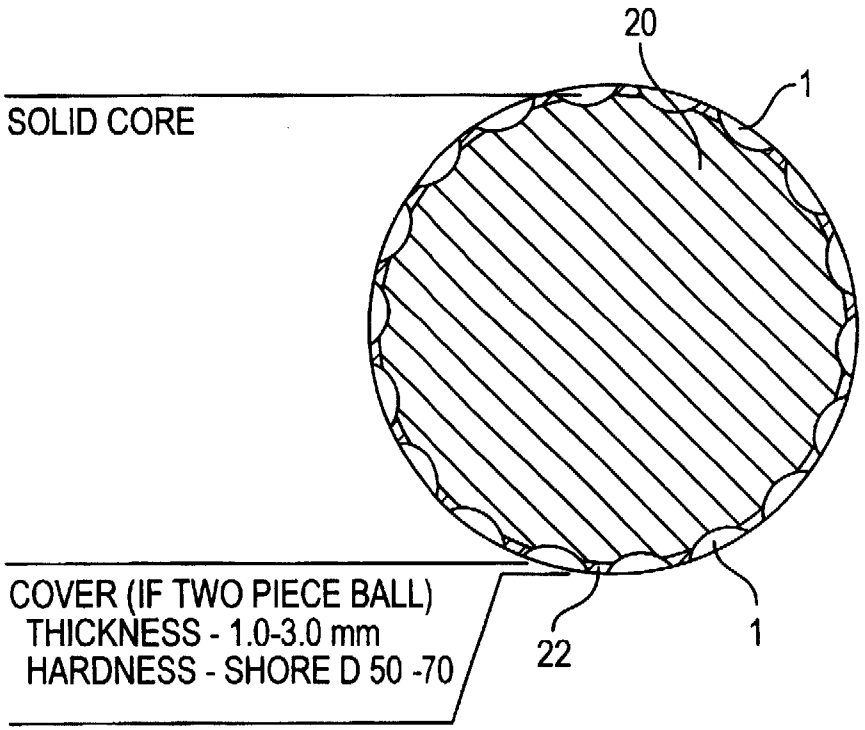
FIG. 4 illustrates a practice golf ball of the present invention.

Referring to FIGS. 1 to 3, the shape of dimples is described in further detail. For simplicity sake, it is now assumed that the shape of a dimple projected on a plane is circular. One dimple in a ball surface is shown in the schematic cross-sectional view of FIG. 1. In conjunction with the dimple 1, there are drawn a phantom sphere 2 having the ball diameter and another phantom sphere 3 having a diameter smaller by 0.16 mm than the ball diameter. The other sphere 3 intersects with the dimple 1 at a point 4. A tangent 5 at intersection 4 intersects with the phantom sphere 2 at a point 6. A series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a circular plane 8 having a diameter Dm. Then the dimple 1 defines a space 9 located below the circular plane 8 and having a depth Dp. The above-mentioned ratio $V_0$ is determined as follows. The dimple space 9 located below the circular plane 8 has a volume Vp as shown in FIG. 2. A cylinder 10 whose bottom is the circular plane 8 and whose height is the maximum depth Dp of the dimple from the bottom or circular plane 8 has a volume Vq. As shown in FIG. 3, the volume Vp of the dimple space 9 and the volume Vq of the cylinder 10 are calculated according to the following equations. The dimple space volume Vp is divided by the cylinder volume Vq to give a ratio $V_0$.

$$Vp = \int_0^{\frac{Dm}{2}} 2\pi xy dx$$

$$Vq = \frac{\pi Dm^2 Dp}{4}$$

$$V_0 = \frac{Vp}{Vq}$$

It is noted that an equivalent diameter is used in the event that the shape of a dimple projected on a plane is not circular. That is, the maximum diameter or length of a dimple projected on a plane is determined, and the plane projected shape of the dimple is assumed to be a circle having a diameter equal to this maximum diameter or length. Based on this assumption, $V_0$ is calculated as above.

The percent dimple volume Vr is calculated according to the formula:

$$Vr = \frac{Vs}{\frac{4}{3}\pi R^3} \times 100\%$$

wherein Vs is a sum of the volumes of dimple spaces each below a circular plane circumscribed by the dimple edge and the ball has a radius R.

The volume vp of the dimple space 9 is determined. The sum Vs of the volumes Vp of the entire dimples is given by the following expression. By substituting the thus obtained value of Vs in the Vr-calculating expression, the value of Vr is determined.

$$Vs = N_1 Vp_1 + N_2 Vp_2 + \ldots + N_n Vp_n = \sum_{i=1}^{n} NiVpi$$

In the expression, $Vp_1$, $Vp_2$, . . . $VP_n$ are the volumes of dimples of different size and $N_1$, $N_2$, . . . $N_n$ are the numbers of dimples having volumes $Vp_1$, $Vp_2$, . . . $VP_n$, respectively.

The dimples formed in the golf ball of the invention are not particularly restricted with respect to shape, size, number of types, and overall number. Preferably the ball has 350 to 450 dimples, more preferably 340 to 440 dimples in total. The arrangement of dimples may be the same as in usual golf balls. Two or more types, especially two to four types of dimples which are different in diameter and depth may be formed. Preferably the dimples have a diameter of 2.5 to 4.5 mm, especially 3.0 to 4.2 mm and a depth of 0.18 to 0.27 mm, especially 0.19 to 0.25 mm.

As previously mentioned, the practice golf ball of the present invention may be either a one-piece golf ball or a two-piece golf ball although other structures are acceptable. The ball may be prepared from well-known stock materials by conventional methods. In the case of a two-piece golf ball, it is recommended from the standpoints of durability and hitting feel that the cover has a Shore D hardness of 50 to 70 and a thickness of 1.0 to 3.0 mm.

There has been described a practice-golf ball which offers a good feel upon shots, follows a low trajectory and provides minimized reduction of flight distance. The ball is best suited for use in urban golf practice pits of limited space.

EXAMPLE

Examples of the present invention are given below by way of illustration and not by way of limitation.

Examples 1–4 & Comparative Examples 1–2

One-piece golf balls (Examples 1, 2 and Comparative Example 1) and solid cores (Examples 3, 4 and Comparative Example 2) were prepared by kneading a rubber compound of the composition shown in Table 1 in a roll mill and heat compression molding the compound at 170° C. for 25 minutes for the one-piece golf balls and at 155° C. for 15 minutes for the solid cores of two-piece golf balls. In Examples 3, 4 and Comparative Example 2, the solid cores were enclosed with a cover to form two-piece golf balls. The cover stock used was a 50/50 mixture of ionomer resins, Himilan 1706 and Himilan 1605 by Mitsui-duPont Polychemical K.K. In either case, the balls were provided with dimples as shown in Tables 2 and 3.

The balls were examined for maximum height, maximum height distance, and hitting feel by the tests described below. The results are shown in Table 3.

Trajectory

Using a swing robot (True Temper Co.), the ball was hit at a head speed of 45 m/sec. with a club having a loft angle of 11°. By taking photographs of the ball in flight, the trajectory that the ball followed was examined to determine the maximum height. The distance at which the ball reached the maximum height was also determined.

Hitting feel

In an actual hitting test, the ball was rated "soft, ""medium" or somewhat "hard."

TABLE 1

| | Core or ball | | | | | |
|---|---|---|---|---|---|---|
| | E1 | E2 | E3 | E4 | CE1 | CE2 |
| Weight (g) | 46.5 | 47.5 | 38.0 | 37.5 | 45.3 | 38.0 |
| Outer diameter (mm) | 42.7 | 42.7 | 38.7 | 38.7 | 42.7 | 38.7 |
| Rubber compound (pbw) | | | | | | |
| Cis-1,4-polybutadiene | 100 | 100 | 100 | 100 | 100 | 100 |
| Zinc acrylate | 0 | 0 | 16 | 17 | 0 | 28 |
| Methacrylic acid | 21 | 18.5 | 0 | 0 | 22.5 | 0 |
| Zinc oxide | 26 | 30 | 40 | 37 | 21 | 36 |
| Dicumyl peroxide | 1 | 1 | 1 | 1 | 1 | 1 |

TABLE 2

| | Dimple type | | | | |
|---|---|---|---|---|---|
| Type | Dm (mm) | Dp (mm) | $V_0$ | Number | Vr (%) |
| A | 3.50 | 0.235 | 0.51 | 240 | 0.92 |
| | 3.00 | 0.210 | 0.51 | 132 | |
| B | 3.70 | 0.230 | 0.48 | 140 | 1.07 |
| | 3.50 | 0.220 | 0.48 | 200 | |
| | 3.20 | 0.210 | 0.48 | 80 | |
| C | 3.55 | 0.220 | 0.43 | 336 | 0.77 |

TABLE 3

| | E1 | E2 | E3 | E4 | CE1 | CE2 |
|---|---|---|---|---|---|---|
| Ball weight (g) | 46.5 | 47.5 | 48.0 | 47.5 | 45.3 | 48.0 |
| Ball diameter (mm) | 42.7 | 42.7 | 42.7 | 42.7 | 42.7 | 42.7 |
| Ball hardness* (mm) | 2.7 | 3.0 | 3.5 | 3.3 | 2.5 | 2.1 |
| Structure | 1-piece | 1-piece | 2-piece | 2-piece | 1-piece | 2-piece |
| Dimple type | A | A | B | B | C | B |
| Hitting feel | medium | medium | soft | soft | medium | hard |

TABLE 3-continued

| | E1 | E2 | E3 | E4 | CE1 | CE2 |
|---|---|---|---|---|---|---|
| Maximum height (m) | 25 | 25 | 24 | 23 | 28 | 24 |
| Max. height distance (m) | 134 | 135 | 138 | 139 | 138 | 138 |

*a distortion (mm) of the golf ball under a constant load of 100 kg

As is evident from Table 3, golf balls within the scope of the invention offer a good feel, reach a relatively low maximum height and follow a low trajectory without substantial shortage of a flight distance.

Japanese Patent Application No. 134249/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A practice golf ball having a multiplicity of dimples formed in its surface, wherein said ball has a weight of 46.5 to 49.0 grams and undergoes a distortion of 2.5 to 4.0 mm under a constant load of 100 kg, and a percent dimple volume Vr is in the range of $0.7\% \leqq Vr \leqq 1.1\%$ wherein the percent dimple volume Vr is the sum of the volumes of the entire dimples divided by the volume of a phantom sphere given on the assumption that the ball surface is free of dimples.

2. The practice golf ball of claim 1 wherein the dimples satisfy $0.40 \leqq V_0 \leqq 0.65$ wherein $V_0$ is the volume of the dimple space below a circular plane circumscribed by the dimple edge, divided by the volume of a cylinder whose bottom is the circular plane and whose height is the maximum depth of the dimple from the bottom.

3. The practice golf ball of claim 1 which is a one-piece golf ball.

4. The practice golf ball of claim 1 which is a two-piece golf ball having a core enclosed with a cover.

* * * * *